US007402715B2

(12) United States Patent
Yoshida et al.

(10) Patent No.: US 7,402,715 B2
(45) Date of Patent: Jul. 22, 2008

(54) FLUIDS FOR TRACTION DRIVE

(75) Inventors: Yukio Yoshida, Chiba (JP); Toshiyuki Tsubouchi, Chiba (JP); Motohisa Ido, Chiba (JP); Hidetoshi Koga, Chiba (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 471 days.

(21) Appl. No.: 10/486,151

(22) PCT Filed: Aug. 2, 2002

(86) PCT No.: PCT/JP02/07925

§ 371 (c)(1),
(2), (4) Date: Feb. 6, 2004

(87) PCT Pub. No.: WO03/014268

PCT Pub. Date: Feb. 20, 2003

(65) Prior Publication Data

US 2004/0181102 A1 Sep. 16, 2004

(30) Foreign Application Priority Data

Aug. 8, 2001 (JP) ..... 2001-240928
Aug. 10, 2001 (JP) ..... 2001-244388

(51) Int. Cl.
*C10M 105/00* (2006.01)
*C10M 169/04* (2006.01)

(52) U.S. Cl. ..... 585/1; 508/110; 252/73

(58) Field of Classification Search ..... 585/1; 508/110; 252/73
See application file for complete search history.

(56) References Cited

U.S. PATENT DOCUMENTS

| | | | | | |
|---|---|---|---|---|---|
| 3,835,050 | A | * | 9/1974 | Green | 508/136 |
| 4,225,736 | A | | 9/1980 | Myers, Jr. | |
| 4,737,297 | A | * | 4/1988 | Yoshida et al. | 508/110 |
| 4,755,317 | A | * | 7/1988 | Minokami et al. | 252/73 |
| 4,889,649 | A | * | 12/1989 | Murai et al. | 252/73 |
| 4,997,586 | A | * | 3/1991 | Mizui et al. | 252/73 |
| 5,043,497 | A | * | 8/1991 | Muraki et al. | 585/20 |

FOREIGN PATENT DOCUMENTS

| | | |
|---|---|---|
| EP | 82967 | 7/1983 |
| EP | 0 207 776 | 1/1987 |
| EP | 0 508 202 | 10/1992 |
| EP | 0 526 218 | 2/1993 |
| EP | 0 578 242 | 1/1994 |
| EP | 949319 | 10/1999 |
| EP | 968987 | 1/2000 |
| EP | 0 989 177 | 3/2000 |
| EP | 1002855 | 5/2000 |
| GB | 1190836 | 5/1970 |
| GB | 2224287 | 5/1990 |
| JP | 57-155295 | 9/1982 |
| JP | 57-155296 | 9/1982 |
| JP | 60-96690 | 5/1985 |
| JP | 1-149897 | 6/1989 |
| JP | 1-156397 | 6/1989 |
| JP | 5-105890 | 4/1993 |
| JP | 5-140574 | 6/1993 |

OTHER PUBLICATIONS

A. Tengalia et al., "Nickel-Catalyzed Dimerization of Norbornene," Journal of Molecular Catalysts, 40 (3), 281-7, Coden: JMCADS; ISSN: 0304-5102, 1987, XP009076510.

D. Musaev, D., et al., "Hydrogenation of Norbornyl Aromatic Hydrocarbons for Jet Fuel Components," Zerbaidzhanskii Khimicheskii Zhurnal, (4) 101-105, Coden: AZKZAU; ISSN: 0005-2531, 1998, XP001248562.

Lehmkuhl et al, "Addition Von Organomagnesiumhalogeniden An C=C-Bindungen, XIII. Kinetische Untersuchungen Zur anlagerung Von 2-Alkyenylmagnesiumverbindungen An Olefine," Justus Liebigs Annalen Der Chemie, Verlag Chemie GMBG, Weinheim, De, vol. 1978, No. 11, Nov. 27, 1978, pp. 1854-1875. XP009076546.

* cited by examiner

*Primary Examiner*—Glenn Caldarola
*Assistant Examiner*—John C Douglas
(74) *Attorney, Agent, or Firm*—Oblon, Spivak, McClelland, Maier & Neustadt, P.C.

(57) ABSTRACT

A fluid for traction drives for automobiles which comprises (A) a hydrocarbon compound having two bridged rings selected from bicyclo[2.2.1]heptane ring, bicyclo[3.2.1]octane ring, bicyclo[3.3.0]octane ring and bicyclo[2.2.2]octane ring and (B) a hydrocarbon compound having at least one structure selected from quaternary carbon atom and ring structures and having a kinematic viscosity at 40° C. of 10 $mm^2/s$ or smaller, and has a viscosity at −40° C. of 40,000 Pa·s or smaller and a flash point of 140° C. or higher, is provided. This fluid exhibits a great traction coefficient at high temperatures and very small viscosity at low temperatures. A fluid for traction drives which comprises a specific bicyclo[2,2,1]heptane derivative having 14 to 17 carbon atoms and having a viscosity index of 0 or greater is also provided. This fluid exhibits improved viscosity-temperature characteristics, decreased viscosity and improved fluidity at low temperatures.

6 Claims, No Drawings

FLUIDS FOR TRACTION DRIVE

TECHNICAL FIELD

The present invention relates to fluids for traction drives. More particularly, the present invention relates to a fluid for traction drives for automobiles exhibiting a great traction coefficient at high temperatures which is important for practical application to continuously variable transmissions (CVT) for automobiles and improved fluidity at low temperatures, i.e., small viscosity at low temperatures, which is important for starting engines at low temperatures.

BACKGROUND ART

Since CVT of the traction drive type for automobiles has a great capacity of torque transfer and the condition in the use is severe, it is essential that a traction oil used for CVT has a traction coefficient sufficiently greater than the value prescribed in the design of CVT at the lowest temperature in the temperature range of the use, which is a high temperature (140° C.).

On the other hand, a small viscosity even at −40° C. is required for starting an engine at low temperatures in cold areas such as northern America and northern Europe. However, the traction coefficient at high temperatures and the property for starting an engine at low temperatures are contradictory properties. A base oil for a traction oil satisfying both of these contradictory properties at a high level has been required.

Moreover, excellent viscosity-temperature characteristics are also essential for practical applications in combination with the small viscosity.

Under the above circumstances, the present inventors discovered a high performance base oil for a traction oil exhibiting excellent properties at high and low temperatures which were not achieved before (Japanese Patent Application Laid-Open No. 2000-17280). This base oil for a traction oil has advantageous properties in that the traction coefficient at high temperatures is greater and the viscosity at low temperatures is remarkably improved in comparison with those of a commercial base oil which is 2,4-dicyclohexyl-2-methylpentane. However, a further improvement in the viscosity at low temperatures have been desired so that the property for starting an engine at low temperatures is further improved.

As the base oil having a small viscosity which is added to the above high performance base oil for traction oils and improves the fluidity at low temperatures without decreasing the traction coefficient at high temperatures, the present inventors have developed a group of compounds having specific structures and exhibiting a viscosity index of 0 or greater by the improvement of the bicyclo[2.2.1]heptane hydrocarbon compound which had been discovered by the present inventors (Japanese Patent Application Publication Heisei 5(1993)-63519).

Under the above circumstances, the present invention has an object of providing a fluid for traction drives for automobiles exhibiting a great traction coefficient at high temperatures which is important for practical application to CVT for automobiles and improved fluidity at low temperatures, i.e., small viscosity at low temperatures, which is important for starting engines at low temperatures.

DISCLOSURE OF THE INVENTION

As the result of the intensive studies by the present inventors on the fluid for traction drives to improve the viscosity characteristics at low temperatures without decreasing the traction coefficient at high temperatures, it was found that the above object could be achieved by mixing a hydrocarbon compound having a small viscosity which had a specific structure and a specific kinematic viscosity to a bridged cyclic hydrocarbon compound having the specific structure which had been discovered by the present inventors before. The present invention has been completed based on this knowledge.

As the first aspect, the present invention provides a fluid for traction drives which comprises (A) a hydrocarbon compound having two bridged rings selected from bicyclo[2.2.1]heptane ring, bicyclo[3.2.1]octane ring, bicyclo[3.3.0]octane ring and bicyclo[2.2.2]octane ring and (B) a hydrocarbon compound having at least one structure selected from quaternary carbon atom and ring structures and having a kinematic viscosity at 40° C. of 10 $mm^2/s$ or smaller, and has a viscosity at −40° C. of 40,000 mPa·s or smaller and a flash point of 140° C. or higher.

As the second aspect, the present invention provides a fluid for traction drives which comprises at least 5% by mass of a bicyclo[2.2.1]heptane derivative having 14 to 17 carbon atom in an entire molecule, having a viscosity index of 0 or greater and represented by following general formula (1) or (2):

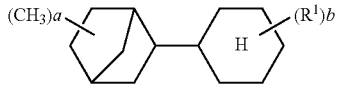

(1)

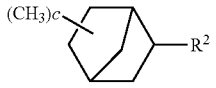

(2)

wherein $R^1$ represents an alkyl group having 1 to 4 carbon atoms, $R^2$ represents a branched alkyl group having 7 to 10 carbon atoms and at least one quaternary carbon atom or an alkyl group having 7 to 10 carbon atoms and a cyclopentane ring, and a, b and c each represent an integer of 0 to 2

THE MOST PREFERRED EMBODIMENT TO CARRY OUT THE INVENTION

In the fluid for traction drives as the first aspect of the present invention, a hydrocarbon compound having two bridged rings selected from bicyclo[2.2.1]heptane ring, bicyclo[3.2.1]octane ring, bicyclo[3.3.0]-octane ring and bicyclo [2.2.2]octane ring is used as component (A) which is the major base oil component.

It is preferable that the hydrocarbon compound having two bridged rings is selected from hydrogenation products of dimers of at least one alicyclic compound selected from bicyclo[2.2.1]heptane ring compounds, bicyclo[3.2.1]octane ring compounds, bicyclo[3.3.0]octane ring compounds and bicyclo[2.2.2]octane ring compounds. The hydrogenation compounds of dimers of bicyclo[2.2.1]heptane ring compounds, i.e., compounds represented by general formula (XI):

(XI)

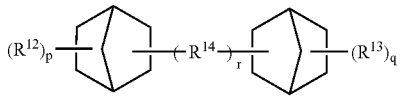

wherein $R^{12}$ and $R^{13}$ each independently represent an alkyl group having 1 to 3 carbon atoms, $R^{14}$ represents methylene group, ethylene group or trimethylene group which may be substituted with methyl group or ethyl group as the side chain, p and q each represent an integer of 0 to 3, and r represents 0 or 1, are more preferable.

As the preferable process for producing the above dimer of an alicyclic compound, for example, an olefin described in the following which may be substituted with an alkyl group is dimerized, hydrogenated and distilled, successively. Examples of the olefin which may be substituted with an alkyl group include bicyclo[2.2.1]hept-2-ene; bicyclo[2.2.1]-hept-2-ene substituted with an alkenyl group such as bicyclo[2.2.1] hept-2-ene substituted with vinyl group or isopropenyl group; bicyclo[2.2.1]hept-2-ene substituted with an alkylidene group such as bicyclo[2.2.1]hept-2-enes substituted with methylene group, ethylidene group or isopropylidene group; bicyclo[2.2.1.]heptane substituted with an alkenyl group such as bicyclo[2.2.1]heptane substituted with vinyl group or isopropenyl group; bicyclo[2.2.1]heptane substituted with an alkylidene group such as bicyclo[2.2.1]heptane substituted with methylene group, ethylidene group or isopropylidene group; bicyclo[3.2.1]octene; bicyclo[3.2.1]octene substituted with an alkenyl group such as bicyclo[3.2.1]octene substituted with vinyl group or isopropenyl group; bicyclo[3.2.1] octene substituted with an alkylidene group such as bicyclo [3.2.1]octene substituted with methylene group, ethylidene group or isopropylidene group; bicyclo[3.2.1]octane substituted with an alkenyl group such as bicyclo[3.2.1]octane substituted with vinyl group or isopropenyl group; bicyclo[3.2.1] octane substituted with an alkylidene group such as bicyclo [3.2.1]octane substituted with methylene group, ethylidene group or isopropylidene group; bicyclo[3.3.0]octene; bicyclo [3.3.0]octene substituted with an alkenyl group such as bicyclo[3.3.0]octene substituted with vinyl group or isopropenyl group; bicyclo[3.3.0]octene substituted with an alkylidene group such as bicyclo[3.3.0]octene substituted with methylene group, ethylidene group or isopropylidene group; bicyclo [3.3.0]octane substituted with an alkenyl group such as bicyclo[3.3.0]octane substituted with vinyl group or isopropenyl group; bicyclo[3.3.0]octane substituted with an alkylidene group such as bicyclo[3.3.0]octane substituted with methylene group, ethylidene group or isopropylidene group; bicyclo [2.2.2]octene; bicyclo[2.2.2]octene substituted with an alkenyl group such as bicyclo[2.2.2]octene substituted with vinyl group or isopropenyl group; bicyclo[2.2.2]octene substituted with an alkylidene group such as bicyclo[2.2.2] octene substituted with methylene group, ethylidene group or isopropylidene group; bicyclo[2.2.2]octane substituted with an alkenyl group such as bicyclo[2.2.2]octane substituted with vinyl group or isopropenyl group; bicyclo[2.2.2]octane substituted with an alkylidene group such as bicyclo[2.2.2] octane substituted with methylene group, ethylidene group or isopropylidene group;

Among the above compounds, the hydrogenation products of dimers of bicyclo[2.2.1]heptane cyclic compounds which are represented by general formula (XI) described above are preferable. Examples of the olefin as the corresponding raw material include bicyclo[2.2.1]hept-2-ene, 2-methylenebicyclo[2.2.1]heptane, 2-methylbicyclo [2.2.1]hept-2-ene, 2-methylene-3-methylbicyclo[2.2.1]heptane, 2,3-dimethylbicyclo [2.2.1]-hept-2-ene, 2-methylene-7-methylbicyclo[2.2.1] heptane, 2,7-dimethylbicyclo-[2.2.1]hept-2-ene, 2-methylene-5-methylbicyclo[2.2.1]heptane, 2,5-dimethylbicyclo[2.2.1]hept-2-ene, 2-methylene-6-methylbicyclo [2.2.1]-heptane, 2,6-dimethylbicyclo[2.2.1]hept-2-ene, 2-methylene-1-methyl-bicyclo-[2.2.1]-heptane, 1,2-dimethylbicyclo[2.2.1]hept-2-ene, 2-methylene-4-methylbicyclo [2.2.1]heptane, 2,4-dimethylbicyclo [2.2.1]hept-2-ene, 2-methylene-3,7-dimethylbicyclo[2.2.1]heptane, 2,3,7-trimethylbicyclo-[2.2.1]hept-2-ene, 2-methylene-3,6-dimethylbicyclo[2.2.1]heptane, 2-methylene-3,3-dimethylbicyclo [2.2.1]heptane, 2,3,6-trimethylbicyclo-[2.2.1]hept-2-ene, 2-methylene-3-ethylbicyclo[2.2.1]heptane and 2-methyl-3-ethylbicyclo[2.2.1]hept-2-ene.

The dimerization described above means not only dimerization of the same type of olefin but also dimerization of plurality of olefins of different types. The dimerization of the olefin described above is conducted, in general, in the presence of a catalyst and, where necessary, by adding a solvent. As the catalyst used for the dimerization, in general, an acid catalyst is used. Examples of the catalyst include mineral acids such as hydrofluoric acid and polyphosphoric acid; organic acids such as triflic acid; Lewis acids such as aluminum chloride, ferric chloride, stannic chloride, boron trifluoride, complexes of boron trifluoride, boron tribromide, aluminum bromide, gallium chloride and gallium bromide; and organoaluminum compounds such as triethylaluminum, diethylaluminum chloride and ethylaluminum dichloride. Among these acids, complexes of boron trifluoride such as boron trifluoride diethyl ether complex, boron trifluoride 1.5 hydrate and boron trifluoride alcohol complexes are preferable.

The amount of the catalyst is not particularly limited. In general, the amount is in the range of 0.1 to 100% by weight and preferably in the range of 1 to 20% by weight based on the amount of the olefin used as the raw material. A solvent is not always necessary in the dimerization. A solvent may be used for handling the olefin of the raw material and the catalyst during the reaction and for adjusting the progress of the reaction. Examples of the solvent include saturated hydrocarbons such as various types of pentane, various types of hexane, various types of octane, various types of nonane and various types of decane; alicyclic hydrocarbons such as cyclopentane, cyclohexane, methylcyclohexane and decaline; ether compounds such as diethyl ether and tetrahydrofuran; compounds having halogens such as methylene chloride and dichloroethane; and nitro compounds such as nitromethane and nitrobenzene.

The dimerization is conducted in the presence of the above catalyst. The temperature of the reaction is, in general, in the range of −70 to 100° C. and preferably in the range of −30 to 60° C. The reaction condition can be set suitably in the above temperature range in accordance with the type of the catalyst and additives. The pressure of the reaction is, in general, the atmospheric pressure and the time of the reaction is, in general, in the range of 0.5 to 10 hours.

The dimer of the raw material obtained as described above is hydrogenated and converted into the hydrogenation product of the dimer of the object compound. The hydrogenation may be conducted using a suitable mixture of a plurality of dimers prepared separately by dimerization of the plurality of corresponding olefins as the raw materials. The hydrogenation is, in general, conducted in the presence of a catalyst. Examples of the catalyst include catalysts for hydrogenation such as nickel, ruthenium, palladium, platinum, rhodium and iridium. In general, the above catalyst is used in the form supported on a support such as diatomaceous earth, alumina, active carbon and silica alumina. Where necessary, solid acids such as zeolite may be used as the cocatalyst of the hydrogenation. Among the above catalysts, nickel supported on diatomaceous earth is preferable from the standpoint of the physical properties of the obtained hydrogenation product. The amount of the catalyst is, in general, in the range of 0.1 to 100% by weight and preferably in the range of 1 to 20% by weight based on the amount of the hydrogenation product.

Similarly to the dimerization described above, a solvent may be used although the hydrogenation can proceed in the absence of solvents. Examples of the solvent include saturated hydrocarbons such as various types of pentane, various types of hexane, various types of octane, various types of nonane and various types of decane; and alicyclic hydrocarbons such as cyclopentane, cyclohexane, methylcyclohexane and decaline.

The temperature of the reaction is, in general, in the range of 100 to 300° C. and preferably in the range of 200 to 300° C. The pressure of the reaction is, in general, in the range of the atmospheric pressure to 20 MPa·G and preferably in the range of the atmospheric pressure to 10 MPa·G. When the pressure is expressed as the partial pressure of hydrogen, the pressure is in the range of 0.5 to 9 MPa·G and preferably in the range of 1 to 8 MPa·G. The time of the reaction is, in general, in the range of 1 to 10 hours. The formed hydrogenation product may be mixed with hydrogenation products formed from different olefins of the raw materials in separated procedures.

In the first aspect of the present invention, the compound having at least two bridged rings may be used as component (A) singly or in combination of two or more.

In the first aspect of the invention, the base oil of component (A) has, in general, the following physical properties: a kinematic viscosity at 40° C. of 10 to 25 $mm^2/s$; a viscosity index of 60 or greater; a pour point of −40° C. or lower; a density at 20° C. of 0.93 $g/cm^3$ or greater; a flash point of 140° C. or higher; and a traction coefficient (the value obtained in accordance with the method using a two-cylinder friction tester described below) at 140° C. of 0.063 or greater.

In the first aspect of the present invention, as component (B) of the base oil, a hydrocarbon compound having a small viscosity, i.e., a hydrocarbon compound having at least one structure selected from quaternary carbon atom and ring structures and having a kinematic viscosity at 40° C. of 10 $mm^2/s$ or smaller, is used. When the kinematic viscosity at 40° C. of component (B) exceeds 10 $mm^2/s$, the fluid for traction drives exhibiting the excellent viscosity characteristics at low temperatures cannot be obtained and the object of the present invention cannot be achieved. It is preferable that the kinematic viscosity at 40° C. is 9 $mm^2/s$ or smaller and more preferably 8.5 $mm^2/s$ or smaller. There is not particular lower limit to the kinematic viscosity. The kinematic viscosity is, in general, 2 $mm^2/s$ or greater.

In the present invention, as the hydrocarbon compound having a small viscosity of component (B), compounds (a) to (h) shown in the following are preferable.

Hydrocarbon Compound (a)

Hydrocarbon compound (a) is an isoparaffin having 15 to 24 carbon atoms which has at least two gem-dimethyl structure. The gem-dimethyl structure means a structure in which two methyl groups are bonded to one carbon atom. Examples of the isoparaffin include 2,2,4,4,6,8,8-heptamethylnonane, 2,4,4,6,6,8,8-heptamethylnonane and 2,4,4,6,8,8, 10,10-nonamethylundecane. The above compound may be used singly or in combination of two or more.

Hydrocarbon Compound (b)

Hydrocarbon compound (b) is a hydrocarbon compound having 13 to 16 carbon atoms and represented by at least one of general formula (I) and general formula (II):

(I)

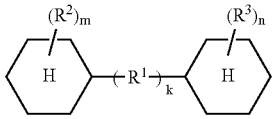

(II)

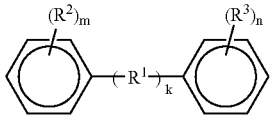

wherein $R^1$ represents a methylene group which may have a methyl branch, $R^2$ and $R^3$ each independently represent an alkyl group having 1 to 3 carbon atoms, k, m and n each represent an integer of 0 to 3, and m+n represents an integer of 0 to 4. Examples of the alkyl group having 1 to 3 carbon atoms which is represented by $R^2$ and $R^3$ in general formulae (I) and (II) include methyl group, ethyl group, n-propyl group and isopropyl group.

Examples of the compound represented by general formula (I) shown above include ethyldicyclohexyl, (methylcyclohexylmethyl)-cyclohexane, 1-cyclohexyl-1-methylcyclohexylethane, trimethyl-dicyclohexyl and diethyldicyclohexyl.

Examples of the compound represented by general formula (II) shown above include ethylbiphenyl, benzyltoluene, phenyltolylethane, trimethylbiphenyl and diethylbiphenyl.

The above hydrocarbon compound may be used singly or in combination of two or more.

Hydrocarbon Compound (c)

Hydrocarbon compound (c) is a hydrocarbon compound having 13 to 24 carbon atoms and represented by at least one of general formula (III) and general formula (IV):

(III)

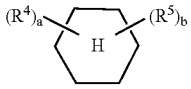

(IV)

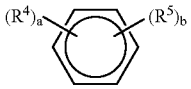

wherein $R^4$ represent an alkyl group having 1 to 7 carbon atoms, $R^5$ represents an alkyl group having 8 to 10 carbon atoms which may have at least one of alkyl branches and cyclopentane ring, a and b each represent an integer of 0 to 3, and a+b represents an integer of 1 to 4. The alkyl group having 1 to 7 carbon atoms which is represented by $R^4$ in general formula (III) and (IV) shown above may be any of a linear alkyl group and a branched alkyl group. Examples of the alkyl group represented by $R^4$ include methyl group, ethyl group, n-propyl group, isopropyl group, various types of butyl group, various types of pentyl group, various types of hexyl group and various types of heptyl group. Examples of the alkyl group having 8 to 10 carbon atoms which may have at least one of alkyl branches and cyclopentane ring and is represented by $R^5$ include various types of octyl group, various types of nonyl group, various types of decyl group, dimethylcyclopentylmethyl group, methylcyclopentylethyl group, dimethylcyclopentylethyl group, trimethylcyclopentyl group and trimethylcyclopentylmethyl group.

Examples of the hydrocarbon compound represented by general formula (III) shown above include 1,4-bis(1,5-dimethylhexyl)cyclohexane, dodecylcyclohexane and octylcyclohexane.

Examples of the hydrocarbon compound represented by general formula (IV) shown above include dodecylbenzene, octyltoluene, octylbenzene and nonylbenzene.

The above hydrocarbon compound may be used singly or in combination of two or more.

Hydrocarbon Compound (d)

Hydrocarbon-compound (d) is a hydrocarbon compound having 12 to 16 carbon atoms and represented by at least one of general formula (V) and general formula (VI):

(V)

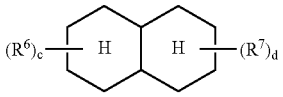

(VI)

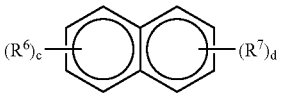

wherein $R^6$ and $R^7$ each independently represent an alkyl group having 1 to 3 carbon atoms, c and d each represent an integer of 0 to 3, and c+d represents an integer of 1 to 6. Examples of the alkyl group having 1 to 3 carbon atoms which is represented by $R^6$ and $R^7$ in general formulae (V) and (VI) shown above include methyl group, ethyl group, n-isopropyl group and isopropyl group.

Examples of the hydrocarbon compound represented by general formula (V) shown above include isopropyldecaline, diisopropyldecaline and diethyldecaline.

Examples of the hydrocarbon compound represented by general formula (VI) shown above include isopropylnaphthalene, diisopropyl-naphthalene and diethylnaphthalene.

The above hydrocarbon compound may be used singly or in combination of two or more.

Hydrocarbon Compound (e)

Hydrocarbon compound (e) is a hydrocarbon compound having 16 to 18 carbon atoms and represented by general formula (VII):

(VII)

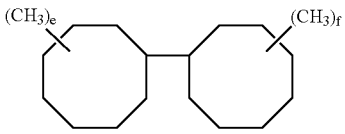

wherein e and f each represent an integer of 0 to 2.

Examples of the hydrocarbon represented by general formula (VII) include dicyclooctyl and dimethyldicyclooctyl.

The above hydrocarbon compound may be used singly or in combination of two or more.

Hydrocarbon Compound (f)

Hydrocarbon compound (f) is a hydrocarbon compound having 13 to 17 carbon atoms and represented by at least one of general formula (VIII) and general formula (IX):

(VIII)

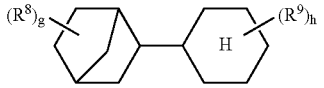

(IX)

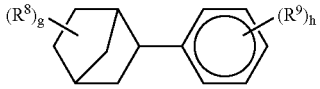

wherein $R^8$ and $R^9$ each independently represent methyl group or ethyl group, g and h each represent an integer of 0 to 3, and g+h represents an integer of 0 to 4.

Examples of the hydrocarbon compound represented by general formula (VIII) shown above include (methylcyclohexyl)dimethylbicyclo-[2.2.1]heptane, cyclohexyldimethylbicyclo[2.2.1]heptane, (methylcyclohexyl)bicyclo[2.2.1]heptane, (dimethylcyclohexyl)bicyclo [2.2.1]-heptane and (methylcyclohexyl)methylbicyclo[2.2.1]heptane.

Examples of the hydrocarbon compound represented by general formula (IX) shown above include (methylphenyl)dimethylbicyclo-[2.2.1]heptane and phenyldimethylbicyclo[2.2.1]heptane.

The above hydrocarbon compound may be used singly or in combination of two or more.

Hydrocarbon Compound (g)

Hydrocarbon compound (g) is a hydrocarbon compound having 13 to 20 carbon atoms and represented by general formula (X):

(X)

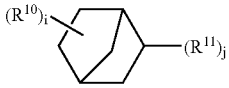

wherein $R^{10}$ represents methyl group or ethyl group, $R^{11}$ represents an alkyl group having 6 to 13 carbon atoms which may have at least one of alkyl branches and cyclopentane ring, i and j each represent an integer of 0 to 3, and i+j represents an integer of 1 to 4. Example of the alkyl group having 6 to 13 carbon atoms which may have at least one of alkyl branches and cyclopentane ring and is represented by $R^{11}$ in general formula (X) shown above include various types of hexyl group, various types of octyl group, various types of decyl group, various types of dodecyl group, cyclopentylmethyl group, methylcyclopentylmethyl group and dimethylcyclopentylmethyl group.

Examples of the hydrocarbon compound represented by general formula (X) shown above include 2-(1,5-dimethylhexyl)bicyclo-[2.2.1]heptane, 2-octylbicyclo[2.2.1]heptane, 2-hexylbicyclo[2.2.1]heptane, octyl-2,3-dimethylbicyclo[2.2.1]heptane, (methylcyclopentylmethyl)-dimethylbicyclo[2.2.1]heptane and (nonyl)methylbicyclo[2.2.1]heptane.

The above hydrocarbon compound may be used singly or in combination of two or more.

Hydrocarbon Compound (h)

As hydrocarbon compound (h), a naphthenic mineral oil is used.

In the first aspect of the present invention, any one of hydrocarbon compounds (a) to (h) or a suitable combination of hydrocarbon compounds (a) to (h) may be used as the hydrocarbon compound having a small viscosity of component (B).

The fluid for traction drives as the first aspect of the present invention comprises the base oil of component (A) and the base oil of component (B) and has a viscosity at −40° C. of 40,000 mPa·s or smaller and a flash point of 140° C. or lower. When the viscosity at −40° C. exceeds 40,000 mPa·s, the effect of improving the properties at low temperatures is not sufficiently exhibited and the object of the present invention cannot be achieved. It is preferable that the viscosity at −40° C. is 35,000 mPa·s or smaller and more preferably 30,000 mPa·s or smaller. There is no particular lower limit to the viscosity. The viscosity is, in general, 5,000 mPa·s or greater. When the flash point is lower than 140° C., there is the possibility that the fluid is ignited. It is preferable that the flash point is 145° C. or higher and more preferably 150° C. or higher.

The relative amounts of component (A) and component (B) in the fluid for traction drives as the first aspect of the present invention are not particularly limited as long as the fluid for traction drives having the above properties can be obtained. In general, the content of component (B) is selected in the range of 1 to 50% by weight, preferably in the range of 2 to 40% by weight and more preferably in the range of 3 to 30% by weight.

The fluid for traction drives as the first aspect of the present invention may further comprise, where desired, base oils having a small viscosity such as poly-α-olefin oils and diesters and base materials for improving the traction coefficient at high temperatures such as dicyclopentadiene-based hydrogenated petroleum resins as long as the object of the present invention such as the excellent traction coefficient at high temperatures and the excellent properties at low temperatures is not adversely affected.

The fluid for traction drives as the second aspect of the present invention is a fluid for traction drives which comprises a bicyclo[2,2,1]heptane derivative having 14 to 17 carbon atom in the entire molecule, represented by general formula (1) or (2) shown above and having a viscosity index of 0 or greater.

The number of carbon atom in the entire molecule is in the range of 14 to 17. When the number of carbon atom is 13 or less, the flash point lowers and the volatility increases. When the number of carbon atom is 18 or more, the viscosity increases and the derivative is not preferable. The viscosity index is 0 or greater. When the viscosity index is smaller than 0, the viscosity-temperature characteristics deteriorate and the derivative is not preferable.

In the following, the bicyclo[2.2.1]heptane derivative represented by general formula (1) will be referred to as Compound 1 and the bicyclo[2.2.1]heptane derivative represented by general formula (2) will be referred to as Compound 2.

In Compound 1, $R^1$ represents an alkyl group having 1 to 4 carbon atoms. Examples of the alkyl group include methyl group, ethyl group, n-propyl group, isopropyl group, n-butyl group, isobutyl group, sec-butyl group and tert-butyl group. Among these groups, methyl group is preferable.

Examples of Compound 1 include methylcyclohexyl-dimethyl-[bicyclo[2.2.1]heptane, cyclohexyl-dimethylbicyclo[2.2.1]heptane, methyl-cyclohexyl-bicyclo[2.2.1]heptane, dimethylcyclohexyl-bicyclo[2.2.1]heptane, dimethylcyclohexyl-dimethylbicyclo [2.2.1]heptane, ethylcyclohexyl-bicyclo[2.2.1]heptane, ethylcyclohexyl-dimethylbicyclo [2.2.1]heptane and methylcyclohexyl-methylbicyclo[2.2.1] heptane.

In Compound 2, $R^2$ represents a branched alkyl group having 7 to 10 carbon atoms and at least one quaternary carbon atom or an alkyl group having 7 to 10 carbon atoms and a cyclopentane ring. Examples of the group represented by $R^2$ include 2,4,4-trimethylpentyl group, neopentyl group, 3,3-dimethylbutyl group, 2,2,4,4-tetramethylpentyl group, methylcyclopentylmethyl group and cyclopentylmethyl group. Among these groups, 2,4,4-trimethylpentyl group and methylcyclopentylmethyl group are preferable.

Examples of Compound 2 include 2,3-dimethyl-2-(2,4-4-trimethyl-pentyl)bicyclo[2.2.1]heptane, 2-methyl-2-(2,4,4-trimethylpentyl)bicyclo-[2.2.1]heptane, 2-methyl-2-(2,2,4,4-tetramethylpentyl)bicyclo[2.2.1]-heptane, methylcyclopentylmethyl-dimethylbicyclo[2.2.1]heptane and cyclopentylmethyl-methylbicyclo[2.2.1]heptane.

In the following, the preferable processes for preparation of Compound 1 and Compound 2 will be described.

Compound 1 can be obtained by the Friedel-Crafts alkylation of the following olefin which may be substituted with one or two methyl groups and the following aromatic compound which may be substituted with an alkyl group having 1 to 4 carbon atoms, followed by hydrogenation of the product.

Examples of the above olefin which may be substituted with one or two methyl groups of the raw material include bicyclo[2.2.1]hept-2-ene, methylenebicyclo[2.2.1]hept-2-ene and methylenebicyclo[2.2.1]heptane. Examples of the above aromatic compound which may be substituted with an alkyl group having 1 to 4 carbon atoms of the raw material include benzene, toluene, o-xylene, m-xylene, p-xylene, ethylbenzene, cumene, cymene, sec-butylbenzene and tert-butylbenzene.

As the catalyst for the Friedel-Crafts alkylation described above, solid acids such as zeolite and active clay; mineral acids such as hydrofluoric acid, polyphosphoric acid, sulfuric acid and hydrochloric acid; organic acids such as triflic acid, p-toluenesulfonic acid and methanesulfonic acid; Lewis acids such as aluminum chloride, ferric chloride, stannic chloride, boron trifluoride, complexes of boron trifluoride, boron tribromide, aluminum bromide, gallium chloride and gallium bromide; and organoaluminum compound such as triethylaluminum, diethylaluminum chloride and ethylaluminum dichloride; can be used.

The amount of the catalyst is not particularly limited. In general, the catalyst is used in an amount in the range of 0.1 to 100 part by mass based on 100 parts by mass of the olefin of the raw material.

The alkylation is conducted in the presence of the above catalyst. The temperature is, in general, 200° C. or lower and preferably 100° C. or lower so that the isomerization is suppressed. There is no lower limit to the temperature as long as the reaction can proceed. From the standpoint of economy, it is preferable that the temperature is −70° C. or higher and more preferably −30° C. or higher. The pressure of the reaction is, in general, the atmospheric pressure. The time of the reaction is, in general, in the range of 0.5 to 10 hours.

As the catalyst of the hydrogenation described above, nickel, ruthenium, palladium, platinum, rhodium and iridium supported with a support such as diatomaceous earth, silica-alumina and active carbon and Raney nickel can be used. Among these catalysts, the supported nickel catalysts such as nickel/diatomaceous earth and nickel/silica-alumina are preferable. The amount of the catalyst is, in general, in the range of 0.1 to 100 parts by mass based on 100 parts by mass of the alkylation product described above.

The hydrogenation of the alkylation product described above is conducted in the presence of the above catalyst. The temperature of the reaction is, in general, in the range of 50 to 300° C. When the temperature is lower than 50° C., there is the possibility that the hydrogenation does not take place sufficiently. When the temperature exceeds 300° C., the yield decreases due to the decomposition reaction. It is preferable that the temperature is in the range of 100 to 280° C. although the preferable temperature is different depending on the catalyst and cannot be generally defined.

The pressure of the reaction is, in general, in the range of the atmospheric pressure to 20 MPa·G and preferably in the range of the atmospheric pressure to 10 MPa·G. The time of the reaction is, in general, in the range of 1 to 10 hours.

Compound 2 can be obtained by codimerization of the following olefin which may be substituted with one or two methyl groups and a branched olefin having 7 to 10 carbon atoms and at least one quaternary carbon atom such as diisobutylene, followed by hydrogenation of the product. Compound 2 can also be obtained by the Diels-Alder reaction of cyclopentadiene which may be substituted with at most two methyl groups and a branched olefin having 7 to 12 carbon atoms and at least one quaternary carbon atom such as diisobutylene and triisobutylene, followed by hydrogenation of the product. Compound 2 having cyclopentadiene ring can be obtained by the retro-Diels-Alder reaction of a dimer of the following olefin which may be substituted with one or two methyl groups, followed by hydrogenation of the product. As for the condition of the retro-Diels-Alder reaction, the dimer of the olefin used as the raw material is placed into an autoclave and subjected to reaction at a temperature, in general, in the range of 200 to 400° C. and preferably in the range of 250 to 350° C. under the spontaneous pressure for a time in the range of 1 to 30 hours.

As the above olefin which may be substituted with one or two methyl groups, the same compounds as those used for the preparation of Compound 1 can be used.

The catalyst used for the dimerization and the condition of the dimerization described above are the same as those for the alkylation described in the preparation of Compound 1.

As for the conditions of the Diels-Alder reaction described above, the cyclopentadiene and the olefin used as the raw materials are placed into an autoclave and subjected to the reaction at a temperature, in general, in the range of 50 to 350° C. and preferably in the range of 100 to 300° C. under the spontaneous pressure for a time in the range of 0.5 to 20 hours. For the reaction, dicyclopentadiene which is the dimer of cyclopentadiene may be used in place of cyclopentadiene, and the reaction may be conducted under heat decomposition of dicyclopentadiene.

The catalyst used for the hydrogenation and the condition of the hydrogenation described above are the same as those for the hydrogenation described in the preparation of Compound 1.

The bicyclo[2.2.1]heptane derivative represented by general formula (1) or (2) which is prepared as described above may be used as a mixture with other fluid for traction drives, where necessary. In this case, it is preferable that the amounts of the components are adjusted so that the resultant fluid contains at least 5% by mass and preferably 30% by mass or more of the bicyclo[2.2.1]heptane derivative.

Where necessary, the fluid for traction drives of the present invention may further comprise various additives such as antioxidants, rust preventives, detergent-dispersants, pour point depressants, viscosity index improvers, extreme pressure agents, antiwear agents, oiliness agents, defoaming agents and corrosion inhibitors.

The present invention will be described more specifically with reference to examples in the following. However, the present invention is not limited to the examples.

The measurement of the traction coefficient in Examples and Comparative Examples was conducted using a two-cylinder friction tester.

<Measurement of the Traction Coefficient>

One of two cylinders having the same size and in contact with each other (the diameter: 52 mm; the thickness: 6 mm; the driven cylinder had a shape with crowning, i.e., a shape having a diameter increasing toward the middle portion, and the driving cylinder had a flat shape without the crowning) was rotated at a constant speed and the other was rotated at a rotation speed changed continuously, and a load of 98.0 N was applied to the contacting point between the two cylinders with a weight. The tangential force, i.e., the traction force, formed between the two cylinders was measured, and the traction coefficient was obtained. The cylinders were made of a mirror finished steel plate for bearings SUJ-2. The average circumferential speed was 6.8 m/s and the contact pressure at the maximum Herz was 1.23 GPa. For the measurement of the traction coefficient at the temperature of the fluid of 140° C., the temperature of the fluid (the oil temperature) was raised from 40° C. to 140° C. by heating the oil tank by a heater, and the traction coefficient was obtained at the slipping ratio of 5%.

COMPARATIVE EXAMPLE 1

Into a 2 liter autoclave made of stainless steel, 561 g (8 moles) of crotonaldehyde and 352 g (2.67 moles) of dicyclopentadiene were placed, and the reaction was allowed to proceed at 170° C. for 3 hours. After the resultant reaction mixture was cooled, 18 g of Raney nickel catalyst (manufactured by KAWAKEN FINE CHEMICALS Co., Ltd.; "M-300T") was added, and the hydrogenation was conducted under a hydrogen pressure of 0.9 MPa at a reaction temperature of 150° C. for 4 hours. After the resulting reaction mixture was cooled, the catalyst was removed by filtration. The filtrate was distilled under a reduced pressure, and 565 g of a fraction of 105° C./2670 Pa was obtained. The fraction was identified to be 2-hydroxymethyl-3-methylbicyclo[2.2.1]heptane by the analysis of the mass spectrum and the nuclear magnetic resonance spectrum.

Into an atmospheric reaction tube of the flow type made of quartz and having an outer diameter of 20 mm and a length of 500 mm, 20 g of γ-alumina (manufactured by NIKKI CHEMICAL Co., Ltd.; "N612N") was placed. The dehydration was conducted at a reaction temperature of 285° C. and a weight hourly space velocity (WHSV) of 1.1 $hr^{-1}$, and 490 g of a dehydration product of 2-hydroxymethyl-3-methylbicyclo[2.2.1]heptane containing 2-methylene-3-methylbicyclo[2.2.1]heptane and 2,3-dimethyl-bicyclo[2.2.1]hept-2-ene was obtained.

Into a 1 liter four-necked flask, 10 g of boron trifluoride diethyl etherate and 490 g of the olefin compound obtained above were placed. The dimerization was conducted for 5 hours under stirring at 10° C. The resultant reaction mixture was washed with a dilute aqueous solution of NaOH and a saturated aqueous solution of sodium chloride. The obtained product was placed into a 1 liter autoclave, and the hydrogenation was conducted after adding 15 g of a nickel/diatomaceous earth catalyst for hydrogenation (manufactured by NIKKI CHEMICAL Co., Ltd.; "N-113") (the hydrogen pressure: 3 MPa; the reaction temperature: 250° C.; the reaction time: 5 hours). After the reaction was completed, the catalyst was removed by filtration. The filtrate was distilled under a reduced pressure, and 340 g of the hydrogenation product of the object product (Fluid A) was obtained. The results of the measurements of the properties and the traction coefficient of the hydrogenation product of the dimer are shown in Table 1.

COMPARATIVE EXAMPLE 2

Into a 500 ml four-necked flask equipped with a reflux condenser, a stirrer and a thermometer, 4 g of active clay (manufactured by MIZUSAWA INDUSTRIAL CHEMICALS, LTD; "GALEON EARTH NS"), 10 g of diethylene glycol monoethyl ether and 200 g of α-methylstyrene were placed. The resultant mixture was heated at a reaction temperature of 105° C. and stirred for 4 hours. After the reaction was completed, the produced liquid was analyzed in accordance with the gas chromatography. It was found that the conversion was 70%; the selectivity of the linear dimer of α-methylstyrene of the object compound was 95%; the selectivity of the cyclic dimer of α-methylstyrene of the side reaction product was 1%; and the selectivity of products having higher boiling points such as trimers was 4%. The obtained reaction product was hydrogenated and distilled under a reduced pressure in accordance with the same procedures as those conducted in Comparative Example 1, and 125 g of the hydrogenation product of the linear dimer of α-methylstyrene, i.e., 2,4-dicyclohexyl-2-methylpentane, (Fluid B) having a purity of 99% was obtained. The results of the measurements of the properties and the traction coefficient of the hydrogenation product of the dimer are shown in Table 1.

EXAMPLE 1

2,2,4,4,6,8,8-Heptamethylnonane (manufactured by TOKYO KASEI KOGYO Co., Ltd.; Fluid 1) was mixed with Fluid A obtained in Comparative Example 1 in an amount such that the content of Fluid 1 in the entire fluid was 10% by weight. The results of the measurements of the properties and the traction coefficient of the fluid are shown in Table 1.

EXAMPLE 2

An isoparaffin-based hydrocarbon (manufactured by IDEMITSU PETROCHEMICAL Co., Ltd; "IP SOLVENT 2028") in an amount of 1 liter was rectified and 350 g of a fraction having a boiling point in the range of 235 to 250° C. (Fluid 2) was obtained. Fluid 2 was mixed with Fluid A obtained in Comparative Example 1 in an amount such that the content of Fluid 2 in the entire fluid was 10% by weight. The results of the measurements of the properties and the traction coefficient of the fluid are shown in Table 1.

EXAMPLE 3

Ethylbiphenyl (manufactured by Nippon Steel Chemical Co., Ltd.; "THERM-S 600"; Fluid 3) was mixed with Fluid A obtained in Comparative Example 1 in an amount such that the content of Fluid 3 in the entire fluid was 10% by weight. The results of the measurements of the properties and the traction coefficient of the fluid are shown in Table 1.

EXAMPLE 4

Into a 2 liter autoclave, 1,200 g of ethylbiphenyl (manufactured by Nippon Steel Chemical Co., Ltd.; "THERM-S 600"; Fluid 3) and 30 g of a nickel/diatomaceous earth catalyst for hydrogenation (manufactured by NIKKI CHEMICAL Co., Ltd.; "N-113") were placed, and the hydrogenation was conducted under a hydrogen pressure of 2 MPa at a reaction temperature of 200° C. for 4 hours. After the reaction was completed, the catalyst was removed by filtration, and 1,200 g of the hydrogenation product of ethylbiphenyl of the object compound (Fluid 4) was obtained. The obtained ethyldicyclohexyl was mixed with Fluid A obtained in Comparative Example 1 in an amount such that the content of ethyldicyclohexyl in the entire fluid was 10% by weight. The results of the measurements of the properties and the traction coefficient of the fluid are shown in Table 2.

EXAMPLE 5

Benzyltoluene (manufactured by SOKEN CHEMICAL & ENGINEERING Co., Ltd.; "NeoSK-OIL 1300"; Fluid 5) was mixed with Fluid A obtained in Comparative Example 1 in an amount such that the content of Fluid 5 in the entire fluid was 10% by weight. The results of the measurements of the properties and the traction coefficient of the fluid are shown in Table 2.

EXAMPLE 6

Into a 2 liter autoclave, 1,200 g of benzyltoluene (manufactured by SOKEN CHEMICAL & ENGINEERING Co., Ltd.; "NeoSK-OIL 1300"; Fluid 5) and 30 g of a nickel/diatomaceous earth catalyst for hydrogenation (manufactured by NIKKI CHEMICAL Co., Ltd.; "N-113") were placed, and the hydrogenation was conducted under a hydrogen pressure of 2 MPa at a reaction temperature of 200° C. for 4 hours. After the reaction was completed, the catalyst was removed by filtration, and 1,000 g of the hydrogenation product of benzyltoluene of the object compound (Fluid 6) was obtained by distillation under a reduced pressure. The obtained (methylcyclohexyl-methyl)cyclohexane was mixed with Fluid A obtained in Comparative Example 1 in an amount such that the content of (methylcyclohexyl-methyl) cyclohexane in the entire fluid was 10% by weight. The results of the measurements of the properties and the traction coefficient of the fluid are shown in Table 2.

EXAMPLE 7

Into a 3 liter four-necked flask, 1,074 g of toluene and 76 g of concentrated sulfuric acid were placed. While the resultant mixture was stirred at 10° C., 450 g of styrene was added dropwise over 2 hours, and the alkylation was conducted. After the resultant reaction mixture was washed with a dilute aqueous solution of NaOH and a saturated aqueous solution of sodium chloride, the unreacted toluene was removed by distillation. The obtained reaction product was placed into a 2 liter autoclave in combination with 20 g of a nickel/diatomaceous earth catalyst for hydrogenation (manufactured by NIKKI CHEMICAL Co., Ltd.; "N-113"), and the hydrogenation was conducted (the hydrogen pressure: 3 MPa; the reaction temperature: 200° C.; the reaction time: 4 hours). After the reaction was completed, the catalyst was removed by filtration. The filtrate was distilled under a reduced pressure, and 420 g of 1-cyclohexyl-1-methylcyclohexylethane of the object product (Fluid 7) was obtained. The obtained 1-cyclohexyl-1-methylcyclohexylethane was mixed with Fluid A obtained in Comparative Example 1 in an amount such that the content of 1-cyclohexyl-1-methylcyclohexylethane in the entire fluid was 10% by weight. The results of the measurements of the properties and the traction coefficient of the fluid are shown in Table 2.

EXAMPLE 8

Into a 3 liter four-necked flask, 880 g of o-xylene and 900 g of concentrated sulfuric acid were placed. While the resultant mixture was stirred at 5° C., a mixture of 465 g of 2-methylcyclohexanol and 440 g of o-xylene was added dropwise over 5 hours, and the alkylation was conducted. After the resultant reaction mixture was washed with a dilute aqueous solution of NaOH and a saturated aqueous solution of sodium chloride, the unreacted o-xylene was removed by distillation. The obtained reaction product was placed into a 2 liter autoclave in combination with 70 g of a nickel/diatomaceous earth catalyst for hydrogenation (manufactured by NIKKI CHEMICAL Co., Ltd.; "N-113"), and the hydrogenation was conducted (the hydrogen pressure: 3 MPa; the reaction temperature: 200° C.; the reaction time: 6 hours). After the reaction was completed, the catalyst was removed by filtration. The filtrate was distilled under a reduced pressure, and 230 g of trimethyldicyclohexy of the object product (Fluid 8) was obtained. The obtained trimethyldicyclohexyl was mixed with Fluid A obtained in Comparative Example 1 in an amount such that the content of trimethyldicyclohexyl in the entire fluid was 10% by weight. The results of the measurements of the properties and the traction coefficient of the fluid are shown in Table 3.

EXAMPLE 9

Dodecylbenzene (manufactured by TOKYO KASEI KOGYO Co., Ltd.; the hard type; Fluid 9) was mixed with Fluid A obtained in Comparative Example 1 in an amount such that the content of dodecylbenzene in the entire fluid was 10% by weight. The results of the measurements of the properties and the traction coefficient of the fluid are shown in Table 3.

EXAMPLE 10

Into a 3 liter four-necked flask, 1,232 g of toluene and 200 g of concentrated sulfuric acid were placed. While the resultant mixture was stirred at 10° C., 500 g of diisobutylene was added dropwise over 3 hours, and the alkylation was conducted. After the resultant reaction mixture was washed with a dilute aqueous solution of NaOH and a saturated aqueous solution of sodium chloride, the unreacted toluene was removed by distillation. The obtained product was distilled under a reduced pressure, and 305 g of the product of alkylation of toluene with isobutylene of the object product (Fluid 10) was obtained as a fraction having a boiling point in the range of 70 to 77° C./200 Pa. The obtained Fluid 10 was mixed with Fluid A obtained in Comparative Example 1 in an amount such that the content of Fluid 10 in the entire fluid was 10% by weight. The results of the measurements of the properties and the traction coefficient of the fluid are shown in Table 3.

EXAMPLE 11

Isopropylnaphthalene (manufactured by SOKEN CHEMICAL & ENGINEERING Co., Ltd.; KSK OIL 260; Fluid 11) was mixed with Fluid A obtained in Comparative Example 1 in an amount such that the content of isopropylnaphthalene in the entire fluid was 10% by weight. The results of the measurements of the properties and the traction coefficient of the fluid are shown in Table 3.

EXAMPLE 12

Into a 2 liter autoclave, 1,200 g of isopropylnaphthalene (manufactured by SOKEN CHEMICAL & ENGINEERING Co., Ltd.; "KSK OIL 260"; Fluid 11) and 30 g of a nickel/diatomaceous earth catalyst for hydrogenation (manufactured by NIKKI CHEMICAL Co., Ltd.; "N-113") were placed, and the hydrogenation was conducted under a hydrogen pressure of 4 MPa at a reaction temperature of 200° C. for. 5 hours. After the reaction was completed, the catalyst was removed by filtration, and 1,000 g of the hydrogenation product of isopropylnaphthalene of the object compound (Fluid 12) was obtained by distillation under a reduced pressure. The obtained isopropyldecaline was mixed with Fluid A obtained in Comparative Example 1 in an amount such that the content of isopropyldecaline in the entire fluid was 10% by weight. The results of the measurements of the properties and the traction coefficient of the fluid are shown in Table 4.

EXAMPLE 13

Into a 1 liter four-necked flask, 100 g of boron trifluoride 1.5 hydrate and 200 ml of heptane were placed. While the resultant mixture was stirred at 20° C., 450 g of cyclooctene was added dropwise over 4 hours, and the dimerization was conducted. After the resultant reaction mixture was washed with a dilute aqueous solution of NaOH and a saturated aqueous solution of sodium chloride, heptane was removed by distillation. The obtained reaction product was placed into a 1 liter autoclave in combination with 15 g of a nickel/diatomaceous earth catalyst for hydrogenation (manufactured by NIKKI CHEICAL Co., Ltd.; "N-113"), and the hydrogenation was conducted (the hydrogen pressure: 3 MPa; the reaction temperature: 200° C.; the reaction time: 3 hours). After the reaction was completed, the catalyst was removed by filtration. The filtrate was distilled under a reduced pressure, and 210 g of the hydrogenation product of the dimer of the object product (Fluid 13) was obtained. The obtained hydrogenation product of the dimer was mixed with Fluid A obtained in Comparative Example 1 in an amount such that the content of the hydrogenation product of the dimer in the entire fluid was 10% by weight. The results of the measurements of the properties and the traction coefficient of the fluid are shown in Table 4.

EXAMPLES 14 AND 15

Into a 2 liter autoclave, 730 g of myrcene and 88 g of dicyclopentadiene were placed. The resultant mixture was stirred at 240° C. for 3 hours, and the Diels-Alder reaction was conducted. After the reaction was completed, the unreacted myrcene Was removed using a rotary evaporator. The obtained reaction mixture in an amount of 727 g was placed into a 2 liter autoclave in combination with 25 g of a nickel/diatomaceous earth catalyst for hydrogenation (manufactured by NIKKI CHEMICAL Co., Ltd.; "N-113"), and the hydrogenation was conducted (the hydrogen pressure: 2 MPa; the reaction temperature: 200° C.; the reaction time: 3 hours). After the reaction was completed, the catalyst was removed by filtration. The filtrate was distilled, and 312 g of a fraction having a boiling point in the range of 118 to 124° C./670 Pa (Fluid 14) and 297 g of a fraction having a boiling point in the range of 147 to 152/670 Pa (Fluid 15) were obtained. As the result of the analysis, it was found that Fluid 14 was 2-(1,5-dimethylhexyl)bicyclo[2.2.1]heptane and Fluid 15 was 1,4-bis(1,5-dimethylhexyl)cyclohexane. In Example 14, Fluid 14 was mixed with Fluid A obtained in Comparative Example 1 in an amount such that the content of Fluid 14 in the entire fluid was 10% by weight. In Example 15, Fluid 15 was mixed with Fluid A obtained in Comparative Example 1 in an amount such that the content of Fluid 15 in the entire fluid was 10% by weight. The results of the measurements of the properties and the traction coefficient of the fluids are shown in Table 4.

EXAMPLE 16

Into a 2 liter autoclave, 700 g of 1-decene and 83 g of dicyclopentadiene were placed. The resultant mixture was stirred at 240° C. for 3 hours, and the Diels-Alder reaction was conducted. After the reaction was completed, the unreacted 1-decene was removed using a rotary evaporator. The obtained reaction mixture in an amount of 258 g was placed into a 2 liter autoclave in combination with 8 g of a nickel/diatomaceous earth catalyst for hydrogenation (manufactured by NIKKI CHEMICAL Co., Ltd.; "N-113"), and the hydrogenation was conducted (the hydrogen pressure: 3 MPa; the reaction temperature: 200° C.; the reaction time: 3 hours). After the reaction was completed, the catalyst was removed by filtration. The filtrate was distilled, and 175 g of a fraction having a boiling point in the range of 119 to 123° C./670 Pa (Fluid 16) was obtained. As the result of the analysis, it was found that Fluid 16 was 2-octylbicyclo[2.2.1]heptane. Fluid 16 was mixed with Fluid A obtained in Comparative Example 1 in an amount such that the content of Fluid 16 in the entire fluid was 10% by weight. The results of the measurements of the properties and the traction coefficient of the fluid are shown in Table 5.

EXAMPLE 17

In accordance with the same procedures as those conducted in Example 16 except that 700 g of 1-octene was used in place of 700 g of 1-decene, 160 g of 2-hexylbicyclo[2.2.1]heptane (Fluid 17) was obtained. Fluid 17 was mixed with Fluid A obtained in Comparative Example 1 in an amount such that the content of Fluid 17 in the entire fluid was 10% by weight. The results of the measurements of the properties and the traction coefficient of the fluid are shown in Table 5.

EXAMPLE 18

Into a 2 liter autoclave made of stainless steel, 561 g (8 moles) of crotonaldehyde and 352 g (2.67 moles) of dicyclopentadiene were placed, and the reaction was allowed to proceed at 170° C. for 3 hours. After the resultant reaction mixture was cooled, 18 g of Raney nickel (manufactured by KAWAKEN FINE CHEMICALS Co., Ltd.; "M-300T") was added, and the hydrogenation was conducted under a hydrogen pressure of 0.9 MPa at a reaction temperature of 150° C. for 4 hours. After the resulting reaction mixture was cooled, the catalyst was removed by filtration. The filtrate was distilled under a reduced pressure, and 565 g of a fraction of 105° C./2,670 Pa was obtained. The fraction was identified to be 2-hydroxymethyl-3-methylbicyclo[2.2.1]heptane by the analysis of the mass spectrum and the nuclear magnetic resonance spectrum.

Into an atmospheric reaction tube of the flow type made of quartz and having an outer diameter of 20 mm and a length of 500 mm, 20 g of γ-alumina (manufactured by NIKKI CHEMICAL Co., Ltd.; "N612N") was placed. The dehydration was conducted at a reaction temperature of 285° C. at a weight hourly space velocity (WHSV) of 1.1 $hr^{-1}$, and 490 g of a dehydration product of 2-hydroxymethyl-3-methylbicyclo[2.2.1]heptane containing 2-methylene-3-methylbicyclo[2.2.1]heptane and 2,3-dimethyl-bicyclo[2.2.1]hept-2-ene was obtained.

Into a 5 liter four-necked flask, 400 g of heptane and 200 g of boron trifluoride diethyl etherate were placed. To the resultant mixture, a mixture of 980 g of the olefin compound obtained above and 900 g of diisobutylene was added dropwise over 6 hours while the mixture was stirred at 10° C. After the resultant reaction mixture was washed with a dilute aqueous solution of NaOH and a saturated aqueous solution of sodium chloride, the obtained product was distilled under a reduced pressure, and 630 g of a fraction having a boiling point in the range of 130 to 133° C./1,070 Pa was obtained. As the result of the analysis, it was found that this fraction was a codimer of the olefins used as the raw materials. The obtained product and 19 g of a nickel/diatomaceous earth catalyst for hydrogenation (manufactured by NIKKI CHEMICAL Co., Ltd.; "N-113") were placed into a 2 liter autoclave, and the hydrogenation was conducted (the hydrogen pressure: 3 MPa; the reaction temperature: 250° C.; the reaction time: 5 hours). After the reaction was completed, the catalyst was removed by filtration, and 620 g of the hydrogenation product of the codimer of the object product (Fluid 18) was obtained. Fluid 18 was mixed with Fluid A obtained in Comparative Example 1 in an amount such that the content of Fluid 18 in the entire fluid was 10% by weight. The results of the measurements of the properties and the traction coefficient of the fluid are shown in Table 5.

EXAMPLE 19

Into a 3 liter four-necked flask, 644 g of toluene and 53 g of concentrated sulfuric acid were placed. While the resultant mixture was stirred at 5° C., 428 g of a dehydration product of 2-hydroxymethyl-3-methylbicyclo[2.2.1]heptane containing 2-methylene-3-methylbicyclo-[2.2.1]heptane and 2,3-dimethylbicyclo[2.2.1]hept-2-ene as the major components was added dropwise over 3 hours, and the alkylation was conducted. After the resultant reaction mixture was washed with a dilute aqueous solution of NaOH and a saturated aqueous solution of sodium chloride, the unreacted toluene was removed by distillation. The obtained reaction product was placed into a 2 liter autoclave in combination with 18 g of a nickel/diatomaceous earth catalyst for hydrogenation (manufactured by NIKKI CHEMICAL Co., Ltd.; "N-113"), and the hydrogenation was conducted (the hydrogen pressure: 2 MPa; the reaction temperature: 250° C.; the reaction time: 8 hours). After the reaction was completed, the catalyst was removed by filtration. The filtrate was distilled under a reduced pressure, and 580 g of (methylcyclohexyl)dimethylbicyclo[2.2.1]heptane of the object product (Fluid 19) was obtained. The obtained Fluid 19 was mixed with Fluid A obtained in Comparative Example 1 in an amount such that the content of Fluid 19 in the entire fluid was 20% by weight. The results of the measurements of the properties and the traction coefficient of the fluid are shown in Table 5.

EXAMPLE 20

The raw material of hydrogenation used in Example 19 was distilled under a reduced pressure, and 590 g of (methylphenyl)-dimethylbicyclo[2.2.1]heptane (Fluid 20) was obtained. The obtained Fluid 20 was mixed with Fluid A obtained in Comparative Example 1 in an amount such that the content of Fluid 20 in the entire fluid was 30% by weight. The results of the measurements of the properties and the traction coefficient of the fluid are shown in Table 6.

EXAMPLE 21

In accordance with the same procedures as those conducted in Example 19 except that 820 g of benzene was used in place of 644 g of toluene, 210 g of cyclohexyldimethylbicyclo[2.2.1]heptane (Fluid 21) was obtained. The obtained Fluid 21 was mixed with Fluid A obtained in Comparative Example 1 in an amount such that the content of Fluid 21 in the entire fluid was 10% by weight. The results of the measurements of the properties and the traction coefficient of the fluid are shown in Table 6.

EXAMPLE 22

Into a 3 liter four-necked flask, 644 g of toluene and 53 g of concentrated sulfuric acid were placed. While the resultant mixture was stirred at 5° C., 330 g of norbornene was added dropwise over 3 hours, and the alkylation was conducted. After the resultant reaction mixture was washed with a dilute aqueous solution of NaOH and a saturated aqueous solution of sodium chloride, the unreacted toluene was removed by distillation. The obtained reaction product was placed into a 2 liter autoclave in combination with 18 g of a nickel/diatomaceous earth catalyst for hydrogenation (manufactured by NIKKI CHEMICAL Co., Ltd.; "N-113"), and the hydrogenation was conducted (the hydrogen pressure: 3 MPa; the reaction temperature: 250° C.; the reaction time: 5 hours). After the reaction was completed, the catalyst was removed by filtration. The filtrate was distilled under a reduced pressure, and 450 g of (methylcyclohexyl)bicyclo[2.2.1]heptane of the object product (Fluid 22) was obtained. The obtained Fluid 22 was mixed with Fluid A obtained in Comparative Example 1 in an amount such that the content of Fluid 22 in the entire fluid was 10% by weight. The results of the measurements of the properties and the traction coefficient of the fluid are shown in Table 6.

EXAMPLE 23

In accordance with the same procedures as those conducted in Example 22 except that 750 g of a mixed xylene was used in place of 644 g of toluene, 470 g of a fluid containing (dimethylcyclohexyl)bicyclo-[2.2.1]heptane as the major component (Fluid 23) was obtained. The obtained Fluid 23 was mixed with Fluid A obtained in Comparative Example 1 in an amount such that the content of Fluid 23 in the entire fluid was 10% by weight. The results of the measurements of the properties and the traction coefficient of the fluid are shown in Table 6.

EXAMPLE 24

Into a 2 liter autoclave, 1,500 g of the dimer of olefins containing 2-methylene-3-methylbicyclo[2.2.1]heptane and 2,3-dimethylbicyclo[2.2.1]-hept-2-ene as the major components which was obtained in Comparative Example 1 was placed and the resultant mixture was heated at 300° C. for 7 hours under stirring. After the reaction mixture was cooled, 30 g of a nickel/diatomaceous earth catalyst for hydrogenation (manufactured by NIKKI CHEMICAL Co., Ltd.; "N-113") was added, and the hydrogenation was conducted (the hydrogen pressure: 3 MPa; the reaction temperature: 250° C.; the reaction time: 5 hours). After the reaction was completed, the catalyst was removed by filtration. The filtrate was rectified under a reduced pressure, and 155 g of (methylcyclopentylmethyl)dimethyl-bicyclo[2.2.1]heptane (Fluid 24) was obtained as a fraction having a boiling point in the range of 127 to 130° C./9,060 Pa. Fluid 24 was mixed with Fluid A obtained in Comparative Example 1 in an amount such that the content of Fluid 24 in the entire fluid was 10% by weight. The results of the measurements of the properties and the traction coefficient of the fluid are shown in Table 7.

EXAMPLE 25

A naphthenic mineral oil ("NA35"; Fluid 25) was mixed with Fluid A obtained in Comparative Example 1 in an amount such that the content of Fluid 25 in the entire fluid was 10% by weight. The results of the measurements of the properties and the traction coefficient of the fluid are shown in Table 7.

COMPARATIVE EXAMPLE 3

A hydrogenation product of a dimer of 1-decene (IDEMITSU "PAO-5002"; Fluid C) was mixed with Fluid A obtained in Comparative Example 1 in an amount such that the content of Fluid C in the entire fluid was 10% by weight. The results of the measurements of the properties and the traction coefficient of the fluid are shown in Table 7. As shown in Table 7, the traction coefficient decreased markedly although the viscosity at the low temperature was improved.

COMPARATIVE EXAMPLE 4

Fluid 4 used in Example 4 was mixed with Fluid B obtained in Comparative Example 2 in an amount such that the content of Fluid 4 in the entire fluid was 10% by weight. The results of the measurements of the properties and the traction coefficient of the fluid are shown in Table 7. As shown in Table 7, the viscosity at the low temperature was great.

COMPARATIVE EXAMPLE 5

An isoparaffin-based hydrocarbon (manufactured by IDEMITSU PETROCHEMICAL Co., Ltd.; "IP SOLVENT 2835"; Fluid D) was mixed with Fluid A obtained in Comparative Example 1 in an amount such that the content of Fluid D in the entire fluid was 10% by weight. The results of the measurements of the properties and the traction coefficient of the fluid are shown in Table 8. As shown in Table 8, the improvement in the viscosity at the low temperature was insufficient.

COMPARATIVE EXAMPLE 6

Fluid D used in Comparative Example 5 was mixed with Fluid B obtained in Comparative Example 2 in an amount such that the content of Fluid D in the entire fluid was 10% by weight. The results of the measurements of the properties and the traction coefficient of the fluid are shown in Table 8. As shown in Table 8, the viscosity at the low temperature was great and the traction coefficient was small.

EXAMPLE 26

Into a 2 liter autoclave made of stainless steel, 561 g (8 moles) of crotonaldehyde and 352 g (2.67 moles) of dicyclopentadiene were placed, and the reaction was allowed to proceed at 170° C. for 3 hours. After the resultant reaction mixture was cooled to the room temperature, 18 g of Raney nickel catalyst (manufactured by KAWAKEN FINE CHEMICALS Co., Ltd.; "M-300T") was added, and the hydrogenation was conducted under a hydrogen pressure of 0.88 MPa·G at a reaction temperature of 150° C. for 4 hours. After the resulting reaction mixture was cooled, the catalyst was removed by filtration. The filtrate was distilled under a reduced pressure, and 565 g of a fraction of 105° C./2.67 kPa was obtained. The fraction was identified to be 2-hydroxymethyl-3-methylbicyclo-[2.2.1]heptane by the analysis of the mass spectrum and the nuclear magnetic resonance spectrum.

Into an atmospheric reaction tube of the flow type made of quartz and having an outer diameter of 20 mm and a length of 500 mm, 20 g of γ-alumina (manufactured by NIKKI CHEMICAL Co., Ltd.; "N612") was placed. The dehydration was conducted at a reaction temperature of 285° C. and a weight hourly space velocity (WHSV) of 1.1 $hr^{-1}$, and 490 g of a dehydration product of 2-hydroxymethyl-3-methylbicyclo[2.2.1]heptane containing 2-methylene-3-methylbicyclo [2.2.1]heptane and 2,3-dimethyl-bicyclo[2.2.1]hept-2-ene was obtained.

Into a 5 liter four-necked flask, 400 g of n-heptane and 200 g of boron trifluoride diethyl etherate were placed. To the resultant mixture, a mixture of 980 g of the olefin compound obtained above and 900 g of diisobutylene was added dropwise over 6 hours while the mixture was stirred at 10° C. After the resultant reaction mixture was washed with a dilute aqueous solution of NaOH and a saturated aqueous solution of sodium chloride, the obtained product was distilled under a reduced pressure, and 630 g of a fraction having a boiling point in the range of 130 to 133° C./1.07 kPa was obtained. As the result of the analysis, it was found that this fraction was a codimer of the olefins used as the raw materials. The obtained product and 19 g of a nickel/diatomaceous earth catalyst for hydrogenation (manufactured by NIKKI CHEMICAL Co., Ltd.; "N-113") were placed into a 2 liter autoclave, and the hydrogenation was conducted (the hydrogen pressure: 29.4 MPa; ·G the reaction temperature: 250° C.; the reaction time: 5 hours). After the reaction was completed, the catalyst was removed by filtration, and 620 g of the hydrogenation product of the codimer of the object product was obtained. The results of the measurements of the properties and the traction coefficient of the fluid are shown in Table 9. The calculated value of the viscosity index is listed in Table 9 for reference although the viscosity index is not applicable unless the kinematic viscosity at 100° C. is 2 $mm^2/s$ or greater.

EXAMPLE 27

Into a 3 liter four-necked flask, 644 g of toluene and 53 g of concentrated sulfuric acid were placed. While the resultant mixture was stirred at 5° C., 428 g of a dehydration product of 2-hydroxymethyl-3-methylbicyclo[2.2.1]heptane containing 2-methylene-3-methylbicyclo-[2.2.1]heptane and 2,3-dimethylbicyclo[2.2.1]hept-2-ene as the major components was added dropwise over 3 hours, and the alkylation was conducted. After the resultant reaction mixture was washed with a dilute aqueous solution of sodium hydroxide and a saturated aqueous solution of sodium chloride, the unreacted toluene was removed by distillation. The obtained reaction product was placed into a 2 liter autoclave in combination with 18 g of a nickel/diatomaceous earth catalyst for hydrogenation (manufactured by NIKKI CHEICAL Co., Ltd.; "N-113"), and the hydrogenation was conducted (the hydrogen pressure: 2 MPa; the reaction temperature: 250° C.; the reaction time: 8 hours). After the reaction was completed, the catalyst was removed by filtration. The filtrate was distilled under a reduced pressure, and 580 g of methylcyclohexyl-dimethylbicyclo[2.2.1]heptane of the object product was obtained. The results of the measurements of the properties and the traction coefficient of the fluid are shown in Table 9.

EXAMPLE 28

In accordance with the same procedures as those conducted in Example 27 except that 820 g of benzene was used in place of 644 g of toluene, 210 g of cyclohexyl-dimethylbicyclo[2.2.1]heptane was obtained. The results of the measurements of the properties and the traction coefficient of the fluid are shown in Table 9.

EXAMPLE 29

Into a 3 liter four-necked flask, 644 g of toluene and 53 g of concentrated sulfuric acid were placed. While the resultant mixture was stirred at 5° C., 330 g of norbornene was added dropwise over 3 hours, and the alkylation was conducted. After the resultant reaction mixture was washed with a dilute aqueous solution of sodium hydroxide and a saturated aqueous solution of sodium chloride, the unreacted toluene was removed by distillation. The obtained reaction product was placed into a 2 liter autoclave in combination with 18 g of a nickel/diatomaceous earth catalyst for hydrogenation (manufactured by NIKKI CHEMICAL Co., Ltd.; "N-113"), and the hydrogenation was conducted (the hydrogen pressure: 3 MPa; the reaction temperature: 250° C.; the reaction time: 5 hours). After the reaction was completed, the catalyst was removed by filtration. The filtrate was distilled under a reduced pressure, and 450 g of methylcyclohexyl-bicyclo [2.2.1]heptane of the object product was obtained. The results of the measurements of the properties and the traction coefficient of the fluid are shown in Table 9. The calculated value of the viscosity index is listed in Table 9 for reference although the viscosity index is not applicable unless the kinematic viscosity at 100° C. is 2 $mm^2/s$ or greater.

EXAMPLE 30

In accordance with the same procedures as those conducted in Example 29 except that 750 g of a mixed xylene was used in place of 644 g of toluene, 470 g of a fluid containing dimethylcyclohexylbicyclo[2.2.1]-heptane as the major component was obtained. The results of the measurements of the properties and the traction coefficient of the fluid are shown in Table 9. The calculated value of the viscosity index is listed in Table 9 for reference although the viscosity index is not applicable unless the kinematic viscosity at 100° C. is 2 $mm^2/s$ or greater.

EXAMPLE 31

In accordance with the same procedures as those conducted in Example 26, 2,200 g of a dehydration product of 2-hydroxymethyl-3-methylbicyclo[2.2.1]heptane containing 2-methylene-3-methylbicyclo-[2.2.1]heptane and 2,3-dimethylbicyclo[2.2.1]hept-2-ene was obtained. The obtained product was placed into a 5 liter four-necked flask in combination with 45 g of boron trifluoride diethyl etherate. The dimerization was conducted for 5 hours under stirring at 10° C. After the reaction mixture was washed with a dilute aqueous solution of NaOH and a saturated aqueous solution of sodium chloride, the unreacted olefin was removed by distillation, and a reaction mixture of the dimerization of the raw material was obtained. The dimer of the olefin in an amount of 1,500 g was placed into a 2 liter autoclave and heated at 300° C. for 7 hours under stirring. After the reaction mixture was cooled, 30 g of a nickel/diatomaceous earth catalyst for hydrogenation (manufactured by NIKKI CHEMICAL Co., Ltd.; "N-113") was added, and the hydrogenation was conducted (the hydrogen pressure: 30 kg/cm$^2$; the reaction temperature: 250° C.; the reaction time: 5 hours). After the reaction was completed, the catalyst was removed by filtration. The filtrate was rectified under a reduced pressure, and 155 g of methylcyclopentylmethyl-dimethylbicyclo[2.2.1]heptane was obtained as a fraction having a boiling point in the range of 127 to 130° C./68 mmHg. The results of the measurements of the properties and the traction coefficient of the fluid are shown in Table 9.

COMPARATIVE EXAMPLE 7

Into a 1 liter four-necked flask, 500 ml of m-xylene as the solvent and the raw material and 90 g of concentrated sulfuric acid as the catalyst were placed, and the resultant mixture was stirred for 0.5 hours. To the mixture at 25° C., a mixed solution of 200.6 g of camphene and 50 ml of m-xylene was added dropwise over 1 hour. The temperature of the reaction solution was 35° C. after the addition. After being stirred for further 20 minutes, the reaction solution was transferred to a separation funnel, and the layer of sulfuric acid was separated and removed. The organic layer was washed twice with 300 ml of a 10% by mass aqueous solution of sodium hydrogencarbonate and twice with 200 ml of a saturated aqueous solution of sodium chloride and dried with anhydrous magnesium sulfate. After the dried solution was kept standing for one night, the drying agent was removed. The solvent and the unreacted raw materials were recovered using a rotary evaporator, and 225 g of the residual reaction solution was obtained. The residual reaction solution was distilled under a reduced pressure, and 176 g of a fraction having a boiling point in the range of 128 to 134° C./2.67 daPa was obtained. In accordance with the gas chromatography-mass analysis (GC-MS) and the gas chromatography (GC) of the hydrogen flame (FID) type, it was found that the fraction obtained above was an addition product of camphene to m-xylene containing 99% or more of the component having 18 carbon atoms. Into a 1 liter autoclave, 175 g of the above fraction and 18 g of a 5% by mass ruthenium/active carbon catalyst for hydrogenation (manufactured by N.E. CHEMCAT CORPORATION) were placed, and the hydrogenation was conducted under a hydrogen pressure of 8.33 MPa·G at a temperature of 160° C. for 7 hours. After the reaction mixture was cooled and the catalyst was removed by filtration, the reaction product was analyzed, and it was found that the fraction of the hydrogenated product was 99% or greater. The results of the measurements of the properties and the traction coefficient of the product are shown in Table 9.

COMPARATIVE EXAMPLE 8

Into a 2 liter four-necked flask, 263.8 g of naphthalene, 1,020 g of carbon tetrachloride as the solvent and 101.7 g of concentrated sulfuric acid as the catalyst were placed, and the resultant mixture was stirred for 0.5 hours while the temperature was kept at 4° C. in an ice bath. To the resultant mixture, a mixed solution of 160.5 g of camphene and 60.4 g of carbon tetrachloride was added dropwise over 4.5 hour. The temperature of the reaction solution was 8° C. after the addition. The reaction solution was transferred to a separation funnel, and the layer of sulfuric acid was separated and removed. The organic layer was washed twice with 300 ml of a 10% by mass aqueous solution of sodium hydrogencarbonate and twice with 200 ml of a saturated aqueous solution of sodium chloride and dried with anhydrous calcium chloride. After the dried solution was kept standing for one night, the drying agent was removed. The solvent and the unreacted raw materials were recovered using a rotary evaporator, and 203 g of the residual reaction solution was obtained. The residual reaction solution was distilled under a reduced pressure, and 142 g of a fraction having a boiling point in the range of 164 to 182° C./2.67 daPa was obtained. In accordance with GC-MS and GC(FID), it was found that the fraction obtained above was an addition product of camphene to naphthalene containing 99% or more of the component having 20 carbon atoms. Into a 1 liter autoclave, 140 g of the above fraction and 15 g of a 5% by mass ruthenium/active carbon catalyst for hydrogenation (manufactured by N.E. CHEMCAT CORPORATION) were placed, and the hydrogenation was conducted under a hydrogen pressure of 8.83 MPa·G at a temperature of 165° C. for 6 hours. After the reaction mixture was cooled and the catalyst was removed by filtration, the reaction product was analyzed, and it was found that the fraction of the hydrogenated product was 99% or greater. The results of the measurements of the properties and the traction coefficient of the product are shown in Table 9. It is shown by the results in Table 9 that the fluids of Examples exhibited smaller viscosity and more excellent fluidity at low temperatures than those of the fluids of Comparative Examples while the traction coefficients were kept almost the same.

TABLE 1-1

| | Comparative Example | | Example | |
|---|---|---|---|---|
| | 1 | 2 | 1 | |
| | [Fluid A] | [Fluid B] | Fluid 1 | mixture |
| Kinematic viscosity (mm$^2$/s) | | | | |
| 40° C. | 17.32 | 20.23 | 3.098 | 13.31 |
| 100° C. | 3.578 | 3.572 | 1.266 | 3.112 |
| Viscosity index | 77 | 13 | — | 88 |
| Pour point (° C.) | −50.0> | −42.5 | −50.0> | −50.0> |
| Viscosity at −40° C. (mPa · s) | 55,000 | 256,000 | 1,000> | 14,000 |
| Density at 20° C. (g/cm$^3$) | 0.9544 | 0.9009 | 0.7877 | 0.9357 |
| Flash point (° C.) | 156 | 164 | 104 | 146 |
| Traction coefficient at 140° C. | 0.077 | 0.070 | 0.044 | 0.069 |
| Content in entire fluid (% by wt) | 100 | 100 | — | 10 |
| [type of main base oil] | [—] | [—] | | [Fluid A] |

TABLE 1-2

| | Example | | | |
|---|---|---|---|---|
| | 2 | | 3 | |
| | Fluid 2 | mixture | Fluid 3 | mixture |
| Kinematic viscosity ($mm^2/s$) | | | | |
| 40° C. | 3.370 | 13.25 | 3.214 | 13.80 |
| 100° C. | 1.279 | 3.067 | 1.160 | 3.089 |
| Viscosity index | — | 81 | — | 70 |
| Pour point (° C.) | −50.0> | −50.0> | −50.0> | −50.0> |
| Viscosity at −40° C. (mPa · s) | 1,000> | 17,100 | 1,000> | 18,400 |
| Density at 20° C. ($g/cm^3$) | 0.7969 | 0.9349 | 1.0053 | 0.9596 |
| Flash point (° C.) | 110 | 148 | 152 | 156 |
| Traction coefficient at 140° C. | 0.042 | 0.068 | 0.022 | 0.065 |
| Content in entire fluid (% by wt) | — | 10 | — | 10 |
| [type of main base oil] | | [Fluid A] | | [Fluid A] |

TABLE 2-1

| | Example | | | |
|---|---|---|---|---|
| | 4 | | 5 | |
| | Fluid 4 | mixture | Fluid 5 | mixture |
| Kinematic viscosity ($mm^2/s$) | | | | |
| 40° C. | 4.035 | 13.98 | 3.115 | 13.79 |
| 100° C. | 1.425 | 3.168 | 1.212 | 3.116 |
| Viscosity index | — | 79 | — | 76 |
| Pour point (° C.) | −50.0> | −50.0> | −50.0> | −50.0> |
| Viscosity at −40° C. (mPa · s) | 1,000> | 21,300 | 1,000> | 16,500 |
| Density at 20° C. ($g/cm^3$) | 0.8860 | 0.9475 | 1.0055 | 0.9594 |
| Flash point (° C.) | 136 | 150 | 148 | 155 |
| Traction coefficient at 140° C. | 0.037 | 0.069 | 0.022 | 0.065 |
| Content in entire fluid (% by wt) | — | 10 | — | 10 |
| [type of main base oil] | | [Fluid A] | | [Fluid A] |

TABLE 2-2

| | Example | | | |
|---|---|---|---|---|
| | 6 | | 7 | |
| | Fluid 6 | mixture | Fluid 7 | mixture |
| Kinematic viscosity ($mm^2/s$) | | | | |
| 40° C. | 4.267 | 14.12 | 6.213 | 14.68 |
| 100° C. | 1.493 | 3.173 | 1.872 | 3.256 |
| Viscosity index | — | 78 | — | 80 |
| Pour point (° C.) | −50.0> | −50.0> | −50.0> | −50.0> |
| Viscosity at −40° C. (mPa · s) | 1,000> | 25,000 | 1,500 | 33,000 |
| Density at 20° C. ($g/cm^3$) | 0.8774 | 0.9465 | 0.8910 | 0.9515 |
| Flash point (° C.) | 126 | 146 | 142 | 152 |
| Traction coefficient at 140° C. | 0.045 | 0.071 | 0.051 | 0.073 |
| Content in entire fluid (% by wt) | — | 10 | — | 10 |
| [type of main base oil] | | [Fluid A] | | [Fluid A] |

TABLE 3-1

| | Example | | | |
|---|---|---|---|---|
| | 8 | | 9 | |
| | Fluid 8 | mixture | Fluid 9 | mixture |
| Kinematic viscosity ($mm^2/s$) | | | | |
| 40° C. | 5.688 | 15.13 | 5.696 | 15.16 |
| 100° C. | 1.802 | 3.279 | 1.672 | 3.269 |
| Viscosity index | — | 76 | — | 70 |
| Pour point (° C.) | −50.0 | −50.0> | −50.0> | −50.0> |
| Viscosity at −40° C. (mPa · s) | 1,100 | 28,700 | 2,400 | 35,000 |
| Density at 20° C. ($g/cm^3$) | 0.8945 | 0.9483 | 0.8695 | 0.9457 |
| Flash point (° C.) | 130 | 148 | 142 | 152 |
| Traction coefficient at 140° C. | 0.056 | 0.074 | 0.022 | 0.065 |
| Content in entire fluid (% by wt) | — | 10 | — | 10 |
| [type of main base oil] | | [Fluid A] | | [Fluid A] |

TABLE 3-2

| | Example | | | |
|---|---|---|---|---|
| | 10 | | 11 | |
| | Fluid 10 | mixture | Fluid 11 | mixture |
| Kinematic viscosity ($mm^2/s$) | | | | |
| 40° C. | 3.492 | 14.01 | 2.642 | 13.40 |
| 100° C. | 1.241 | 3.128 | 1.016 | 3.026 |
| Viscosity index | — | 72 | — | 68 |
| Pour point (° C.) | −50.0> | −50.0> | −50.0> | −50.0> |
| Viscosity at −40° C. (mPa · s) | 1,000> | 18,100 | 1,000> | 17,800 |
| Density at 20° C. ($g/cm^3$) | 0.8708 | 0.9458 | 1.016 | 0.9606 |
| Flash point (° C.) | 120 | 147 | 130 | 150 |
| Traction coefficient at 140° C. | 0.046 | 0.071 | 0.033 | 0.068 |
| Content in entire fluid (% by wt) | — | 10 | — | 10 |
| [type of main base oil] | | [Fluid A] | | [Fluid A] |

TABLE 4-1

| | Example | | | |
|---|---|---|---|---|
| | 12 | | 13 | |
| | Fluid 12 | mixture | Fluid 13 | mixture |
| Kinematic viscosity ($mm^2/s$) | | | | |
| 40° C. | 3.058 | 13.32 | 7.817 | 15.59 |
| 100° C. | 1.209 | 3.078 | 2.144 | 3.349 |
| Viscosity index | — | 83 | 61 | 75 |
| Pour point (° C.) | −50.0> | −50.0> | −50.0> | −50.0> |
| Viscosity at −40° C. (mPa · s) | 1,000> | 18,200 | 3,200 | 35,000 |
| Density at 20° C. ($g/cm^3$) | 0.8862 | 0.9476 | 0.8878 | 0.9476 |
| Flash point (° C.) | 108 | 144 | 140 | 152 |
| Traction coefficient at 140° C. | 0.043 | 0.070 | 0.050 | 0.073 |
| Content in entire fluid (% by wt) | — | 10 | — | 10 |
| [type of main base oil] | | [Fluid A] | | [Fluid A] |

TABLE 4-2

| | Example | | | |
|---|---|---|---|---|
| | 14 | | 15 | |
| | Fluid 14 | mixture | Fluid 15 | mixture |
| Kinematic viscosity ($mm^2/s$) | | | | |
| 40° C. | 4.516 | 14.65 | 9.892 | 16.25 |
| 100° C. | 1.549 | 3.232 | 2.475 | 3.435 |
| Viscosity index | — | 76 | 58 | 75 |
| Pour point (° C.) | −50.0> | −50.0> | −50.0> | −50.0> |
| Viscosity at −40° C. (mPa · s) | 1,000> | 28,000 | 10,500 | 41,000 |
| Density at 20° C. ($g/cm^3$) | 0.8642 | 0.9455 | 0.8440 | 0.9432 |
| Flash point (° C.) | 132 | 152 | 166 | 160 |
| Traction coefficient at 140° C. | 0.042 | 0.070 | 0.030 | 0.067 |
| Content in entire fluid (% by wt) | — | 10 | — | 10 |
| [type of main base oil] | | [Fluid A] | | [Fluid A] |

TABLE 5-1

| | Example | | | |
|---|---|---|---|---|
| | 16 | | 17 | |
| | Fluid 16 | mixture | Fluid 17 | mixture |
| Kinematic viscosity ($mm^2/s$) | | | | |
| 40° C. | 4.262 | 13.69 | 2.820 | 13.57 |
| 100° C. | 1.541 | 3.142 | 1.137 | 3.085 |
| Viscosity index | — | 84 | — | 76 |
| Pour point (° C.) | −50.0> | −50.0> | −50.0> | −50.0> |
| Viscosity at −40° C. (mPa · s) | 1,000> | 19,000 | 1,000> | 17,700 |
| Density at 20° C. ($g/cm^3$) | 0.8606 | 0.9444 | 0.8592 | 0.9446 |
| Flash point (° C.) | 138 | 148 | 108 | 142 |
| Traction coefficient at 140° C. | 0.036 | 0.068 | 0.035 | 0.066 |
| Content in entire fluid (% by wt) | — | 10 | — | 10 |
| [type of main base oil] | | [Fluid A] | | [Fluid A] |

TABLE 5-2

| | Example | | | |
|---|---|---|---|---|
| | 18 | | 19 | |
| | Fluid 18 | mixture | Fluid 19 | mixture |
| Kinematic viscosity ($mm^2/s$) | | | | |
| 40° C. | 6.164 | 15.20 | 8.242 | 14.73 |
| 100° C. | 1.959 | 3.338 | 2.124 | 3.194 |
| Viscosity index | — | 82 | 31 | 66 |
| Pour point (° C.) | −50.0> | −50.0> | −50.0> | −50.0> |
| Viscosity at −40° C. (mPa · s) | 1,000> | 26,800 | 9,800 | 34,200 |
| Density at 20° C. ($g/cm^3$) | 0.8666 | 0.9454 | 0.9194 | 0.9474 |
| Flash point (° C.) | 134 | 156 | 142 | 150 |
| Traction coefficient at 140° C. | 0.047 | 0.072 | 0.068 | 0.075 |
| Content in entire fluid (% by wt) | — | 10 | — | 20 |
| [type of main base oil] | | [Fluid A] | | [Fluid A] |

TABLE 6-1

| | Example | | | |
|---|---|---|---|---|
| | 20 | | 21 | |
| | Fluid 20 | mixture | Fluid 21 | mixture |
| Kinematic viscosity ($mm^2/s$) | | | | |
| 40° C. | 8.110 | 13.53 | 7.034 | 15.60 |
| 100° C. | 2.008 | 2.961 | 2.002 | 3.350 |
| Viscosity index | −3 | 50 | 61 | 75 |
| Pour point (° C.) | −50 | −50.0> | −50.0> | −50.0> |
| Viscosity at −40° C. (mPa · s) | 8,600 | 34,800 | 3,500 | 34,200 |
| Density at 20° C. ($g/cm^3$) | 0.9702 | 0.9581 | 0.9242 | 0.9516 |
| Flash point (° C.) | 148 | 156 | 130 | 150 |
| Traction coefficient at 140° C. | 0.059 | 0.072 | 0.067 | 0.075 |
| Content in entire fluid (% by wt) | — | 30 | — | 10 |
| [type of main base oil] | | [Fluid A] | | [Fluid A] |

TABLE 6-2

| | Example | | | |
|---|---|---|---|---|
| | 22 | | 23 | |
| | Fluid 22 | mixture | Fluid 23 | mixture |
| Kinematic viscosity ($mm^2/s$) | | | | |
| 40° C. | 5.146 | 15.12 | 6.059 | 15.24 |
| 100° C. | 1.686 | 3.297 | 1.825 | 3.305 |
| Viscosity index | — | 76 | — | 75 |
| Pour point (° C.) | −50.0> | −50.0 | −50.0> | −50.0> |
| Viscosity at −40° C. (mPa · s) | 1,000> | 28,800 | 1,800 | 30,700 |
| Density at 20° C. ($g/cm^3$) | 0.9226 | 0.9481 | 0.9205 | 0.9507 |
| Flash point (° C.) | 128 | 150 | 140 | 153 |
| Traction coefficient at 140° C. | 0.048 | 0.072 | 0.055 | 0.072 |
| Content in entire fluid (% by wt) | — | 10 | — | 10 |
| [type of main base oil] | | [Fluid A] | | [Fluid A] |

TABLE 7-1

| | Example | | | |
|---|---|---|---|---|
| | 24 | | 25 | |
| | Fluid 24 | mixture | Fluid 25 | mixture |
| Kinematic viscosity ($mm^2/s$) | | | | |
| 40° C. | 7.094 | 15.53 | 2.420 | 13.18 |
| 100° C. | 2.169 | 3.378 | 1.030 | 3.013 |
| Viscosity index | 190 | 82 | — | 76 |
| Pour point (° C.) | −50.0> | −50.0> | −50.0> | −50.0> |
| Viscosity at −40° C. (mPa · s) | 1,300 | 29,800 | 1,000> | 17,100 |
| Density at 20° C. ($g/cm^3$) | 0.9279 | 0.9518 | 0.8231 | 0.9413 |
| Flash point (° C.) | 141 | 154 | 118 | 146 |
| Traction coefficient at 140° C. | 0.048 | 0.073 | 0.015 | 0.062 |
| Content in entire fluid (% by wt) | — | 10 | — | 10 |
| [type of main base oil] | | [Fluid A] | | [Fluid A] |

TABLE 7-2

| | Comparative Example | | | |
|---|---|---|---|---|
| | 3 | | 4 | |
| | Fluid C | mixture | Fluid 4 | mixture |
| Kinematic viscosity ($mm^2/s$) | | | | |
| 40° C. | 5.279 | 15.03 | 4.035 | 16.40 |
| 100° C. | 1.745 | 3.293 | 1.425 | 3.192 |
| Viscosity index | — | 78 | — | 21 |
| Pour point (° C.) | −50.0> | −50.0> | −50.0> | −50.0 |
| Viscosity at −40° C. (mPa · s) | 1,000> | 17,000 | 1,000> | 112,000 |
| Density at 20° C. ($g/cm^3$) | 0.7978 | 0.9387 | 0.8860 | 0.8996 |
| Flash point (° C.) | 171 | 162 | 136 | 158 |
| Traction coefficient at 140° C. | 0.004 | 0.057 | 0.037 | 0.062 |
| Content in entire fluid (% by wt) | — | 10 | — | 10 |
| [type of main base oil] | | [Fluid A] | | [Fluid B] |

TABLE 8

| | Comparative Example | | | |
|---|---|---|---|---|
| | 5 | | 6 | |
| | Fluid D | mixture | Fluid D | mixture |
| Kinematic viscosity ($mm^2/s$) | | | | |
| 40° C. | 12.70 | 16.72 | 12.70 | 19.16 |
| 100° C. | 2.740 | 3.472 | 2.740 | 3.470 |
| Viscosity index | 22 | 71 | 22 | 15 |
| Pour point (° C.) | −50.0> | −50.0> | −50.0> | −46.0 |
| Viscosity at −40° C. (mPa · s) | 46,000 | 52,000 | 46,000 | 211,000 |
| Density at 20° C. ($g/cm^3$) | 0.820 | 0.9410 | 0.820 | 0.8927 |
| Flash point (° C.) | 146 | 141 | 146 | 160 |
| Traction coefficient at 140° C. | 0.043 | 0.068 | 0.043 | 0.061 |
| Content in entire fluid (% by wt) | — | 10 | — | 10 |
| [type of main base oil] | | [Fluid A] | | [Fluid B] |

TABLE 9-1

| | Example | | | |
|---|---|---|---|---|
| | 26 | 27 | 28 | 29 |
| Kinematic viscosity at 40° C. ($mm^2/s$) | 6.164 | 8.242 | 7.034 | 5.146 |
| Kinematic viscosity at 100° C. ($mm^2/s$) | 1.959 | 2.124 | 2.002 | 1.686 |
| Viscosity index | (98) | 31 | 61 | (71) |
| Pour point (° C.) | −50.0> | −50.0> | −50.0> | −50.0> |
| Density at 20° C. ($g/cm^3$) | 0.8666 | 0.9194 | 0.9242 | 0.9226 |
| Traction coefficient at 40° C. | 0.094 | 0.099 | 0.097 | 0.096 |

TABLE 9-2

| | Example | | Comparative Example | |
|---|---|---|---|---|
| | 30 | 31 | 7 | 8 |
| Kinematic viscosity at 40° C. ($mm^2/s$) | 6.059 | 7.094 | 16.17 | 138.8 |
| Kinematic viscosity at 100° C. ($mm^2/s$) | 1.825 | 2.169 | 3.030 | 7.380 |
| Viscosity index | (56) | 109 | −13 | −157 |
| Pour point (° C.) | −50.0> | −50.0> | −35.0 | −7.5 |

TABLE 9-2-continued

| | Example | | Comparative Example | |
|---|---|---|---|---|
| | 30 | 31 | 7 | 8 |
| Density at 20° C. ($g/cm^3$) | 0.9205 | 0.9279 | 0.9240 | 0.9638 |
| Traction coefficient at 40° C. | 0.095 | 0.095 | 0.098 | 0.094 |

INDUSTRIAL APPLICABILITY

In accordance with the first aspect of the present invention, the fluid for traction drives for automobiles exhibiting a great traction coefficient at high temperatures which is important for practical application to CVT for automobiles and improved fluidity at low temperatures, i.e., small viscosity at low temperatures, which is important for starting engines at low temperatures, can be provided. By the use of this fluid for traction drives, CVT of the traction drive type can be applied to automobiles in areas ranging from cold areas such as northern America and northern Europe to extremely hot desert areas.

The fluid for traction drives of the second aspect of the present invention exhibits the improved viscosity-temperature characteristics and the combination of the decreased viscosity and the improved fluidity at low temperatures and can be used in the whole world ranging from cold areas to hot areas for practical applications to the CVT oil of the traction drive type as the base material having a small viscosity which exhibits the improved fluidity at low temperatures without adverse effects on the traction coefficient at high temperatures.

The invention claimed is:

1. A fluid which comprises a bicyclo[2.2.1]heptane derivative having 14 to 17 carbon atoms in an entire molecule, having a viscosity index of 0 or greater and represented by following general formula (1):

(1)

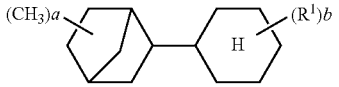

wherein R1 represents an alkyl group having 1 to 4 carbon atoms, a is 2, and b represents an integer of 0 to 2.

2. A fluid according to claim 1, which comprises at least 5% by mass of the bicyclo[2.2.1]heptane derivative.

3. A fluid which comprises a bicyclo[2.2.1]heptane derivative having 14 to 17 carbon atoms in an entire molecule, having a viscosity index of 0 or greater and represented by following general formula (2):

(2)

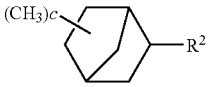

wherein $R^2$ represents a branched alkyl group having 7 to 10 carbon atoms and at least one quaternary carbon atom, or an alkyl group having 7 to 10 carbon atoms and a cyclopentane ring, and c represents an integer of 0 to 2.

4. A fluid according to claim 3, which comprises at least 5% by mass of the bicyclo[2.2.1]heptane derivative.

5. A traction drive comprising a fluid, said fluid comprising a bicyclo[2.2.1]heptane derivative having 14 to 17 carbon atoms in an entire molecule, having a viscosity index of 0 or greater and represented by following general formula (1) or (2):

(1)

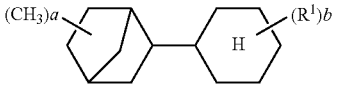

(2)

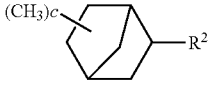

wherein $R^1$ represents an alkyl group having 1 to 4 carbon atoms, $R^2$ represents a branched alkyl group having 7 to 10 carbon atoms and at least one quaternary carbon atom, or an alkyl group having 7 to 10 carbon atoms and a cyclopentane ring, and a, b and c each represent an integer of 0 to 2.

6. A traction drive according to claim 5, wherein said fluid comprises at least 5% by mass of the bicyclo[2.2.1]heptane derivative.

* * * * *